United States Patent [19]

Barabe

[11] Patent Number: 4,677,699

[45] Date of Patent: Jul. 7, 1987

[54] WAIST BAND ADJUSTMENT FOR GARMENT

[76] Inventor: David J. Barabe, 2741 Lansdale La., Winston Salem, N.C. 27103

[21] Appl. No.: 886,569

[22] Filed: Jul. 16, 1986

[51] Int. Cl.[4] ..... A41D 1/14

[52] U.S. Cl. ..... 2/221; 2/237; 2/DIG. 6

[58] Field of Search ..... 2/221, 220, 237, 236, 2/DIG. 6

[56] References Cited

U.S. PATENT DOCUMENTS

| | | | |
|---|---|---|---|
| 2,173,468 | 9/1939 | Bennett . | |
| 2,413,180 | 12/1946 | Grisarti | 2/237 |
| 2,439,339 | 4/1948 | Grisanti | 2/237 |
| 2,837,748 | 6/1958 | Manning et al. | 2/221 X |
| 3,141,457 | 7/1964 | Davidson . | |
| 3,820,163 | 6/1974 | Rappleyea . | |
| 4,316,333 | 2/1982 | Rothschild | 2/DIG. 6 X |
| 4,534,068 | 8/1985 | Mitchell et al. . | |

FOREIGN PATENT DOCUMENTS

| | | | |
|---|---|---|---|
| 980766 | 1/1965 | United Kingdom | 2/237 |

*Primary Examiner*—Ronald Feldbaum
*Assistant Examiner*—J. L. Olds
*Attorney, Agent, or Firm*—Richard E. Jenkins

[57] ABSTRACT

A waist band adjustment means including a first flexible strip which is attached to the inside of the waist band of a garment and includes VELCRO on the inner face thereof. A second flexible strip is provided and includes VELCRO on one face thereof in order that the second flexible strip may be removably attached to the first strip as needed to accommodate increases and decreases in waist size due to weight gain or loss.

8 Claims, 4 Drawing Figures

WAIST BAND ADJUSTMENT FOR GARMENT

TECHNICAL FIELD

The present invention relates to adjustable waist bands and particularly to an improved waist band adjustment of simple construction which is adapted to compensate for the gain or loss of a small amount of weight by the addition or removal of a portion of the waist band adjustment in order to provide a snug but comfortable fit of the garment waist band.

BACKGROUND ART

It is common knowledge among people who have reached middle-age that relatively small swings in weight are common place as efforts are made to maintain body weight at a desired level through exercise and dietary control. This is of particular concern since jogging, aerobics and NAUTILUS type exercise has been undertaken by a large part of our middle-age population. Unlike younger persons, this exercise and the weight fluctuations associated therewith creates some difficulty to middle-age persons since garment waist bands tend to become either a little too tight or a little too loose. Although adjustable waist bands are known which incorporate elastic or the like, such as the SANS-A-BELT, the garments which provide these features tend to be somewhat casual and are therefore quite limited in their use.

Applicant has developed a waist band adjustment which may be incorporated into the waist band of essentially all types of garments including both casual and more formal garments. Thus, it is believed that applicant's invention provides a solution to a widely felt need by middle-age persons and others with small weight fluctuations to the frequent discomfort of a too tight or too loose garment waist band.

DISCLOSURE OF THE INVENTION

In accordance with the present invention, applicant provides a garment waist band adjustment designed specifically to enable a person to compensate for small increases and decreases in their weight so as to allow their garment waist band to remain comfortable. This is particularly a problem with middle-age persons today who are making an effort to maintain their fitness by participating in jogging, aerobics, NAUTILUS exercise and related physical activity. Typically, a middle-age person participating in one or more of these activities will find their weight fluctuating up and down about five pounds or so and the waist band of their wearing apparel to be either slightly too tight or too loose. Although elastic belt lines and SANS-A-BELT type garments will compensate for these type of weight fluctuations, applicant has observed that these type of garments are limited primarily to certain casual and informal attire and, moreover, are quite limited in their availability. Applicant's waist band adjustment will be readily available for use in all wearing apparel having a waist band since it is contemplated that it may be provided by either the apparel manufacturer in the garment at initial purchase or may be easily sewn into the inside of the waist band of a new garment by the purchaser. Therefore, its simplicity of use and wide applicability should render it very desirable.

The invention provides a waist band adjustment for a garment comprising most preferably a pair of first flexible strips which are sewn to the inside of the waist band of the garment on opposing sides thereof with the VELCRO side of each strip facing outwardly toward the other. A second pair of flexible strips having a VELCRO fastening side is provided for attachment to the pair of first flexible strips. As will be understood by those familiar with VELCRO, the pair of first strips are most suitably provided with VELCRO loops and the pair of second strips are provided with VELCRO hooks in order that the first and second strips may be removably secured together with the VELCRO fastening means. Of course, as a matter of design choice the loops and hooks could be reversed with respect to their position on the first and second flexible strips without affecting the performance of the instant invention. Furthermore, it should be appreciated that the pair of first flexible strips comprise a generally elongate and rectilinear shape for securement to the inside waist band of the garment and the pair of second flexible strips are fashioned so as to be substantially coextensive with the pair of first flexible strips. In this fashion, the waist band of a garment may be adjusted about 1 to 1.5 inches by the attachment and removal of the pair of second flexible strips in order to accommodate weight losses and gains of about five pounds or more without requiring the expensive and time consuming aid of a tailor.

It is therefore a primary object of the invention to provide an improved waist band adjustment for apparel garments in order to accommodate relatively small changes in waist size due to the gain or loss of weight.

A further object of the invention is to provide a simple and inexpensive adjustment for the waist band of all types of garments including both casual and formal attire.

A still further object of the invention is to provide a waist band adjustment which may be utilized by the owner of the garment to accommodate for a change in waist size without requiring the time and expense of a tailor.

Some of the objects of the invention having been stated, other objects will become evident as the description proceeds, when taken in connection with the accompanying drawings.

BEST MODE FOR CARRYING OUT THE INVENTION

Figure 1:
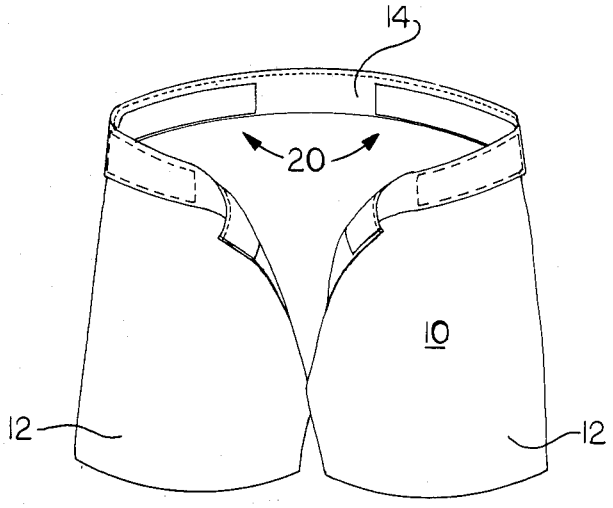
FIG. 1 illustrates in perspective view a garment embodying the waist band adjustment of the present invention.

Referring now to the detailed drawings, FIG. 1 illustrates a pair of conventional shorts 10 including leg elements 12 and a waist band 14 being integrally joined to the upper margin of the garment by suitable stitching or other conventional means. It will be appreciated, of course, that although shorts 10 are illustrated, any type of garment having a waist band around the top thereof could have been illustrated including but not limited to women's skirts, shorts for both men and women, and long pants for both men and women.

Figure 2:
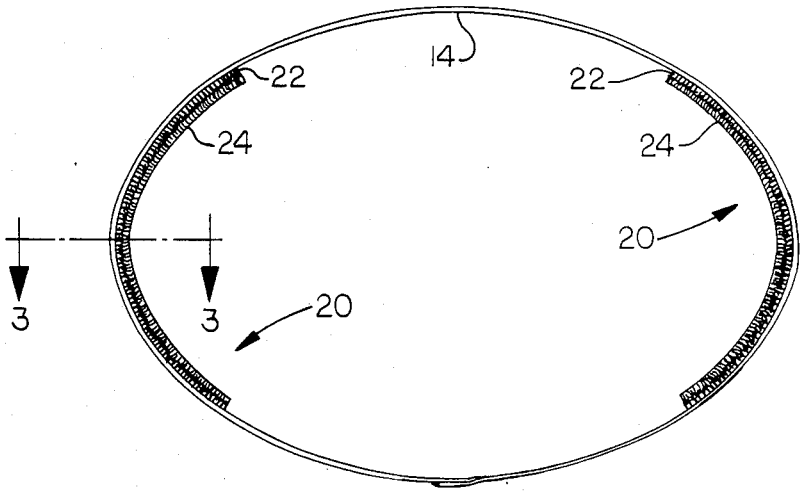
FIG. 2 is a plan view of the top of the garment of FIG. 1.

With the garment shown in FIG. 1 and described hereinbefore, the invention combines a waist band adjustment generally designated 20, which is sewn or otherwise secured to the inside of the waist band as best seen in FIGS. 1 and 2. Although the preferred embodiment contemplated by the invention provides for a pair of waist band adjustments 20 to be provided on opposing sides of waist band 14 of a garment as depicted in the drawings, it should be appreciated that a singular waist band adjustment 20 could be appropriately positioned to the waist band of a garment or perhaps three or more pairs of waist band adjustments 20 could be positioned thereto according to the particular needs and preference of a given individual and dependent upon the actual size of the waist band of the garment.

Figure 3:
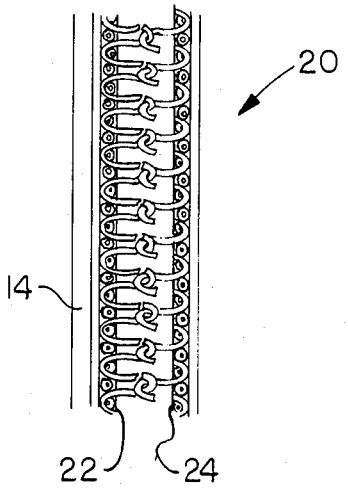
FIG. 3 is a cross-sectional view taken on line 3—3 of FIG. 2.
Figure 4:
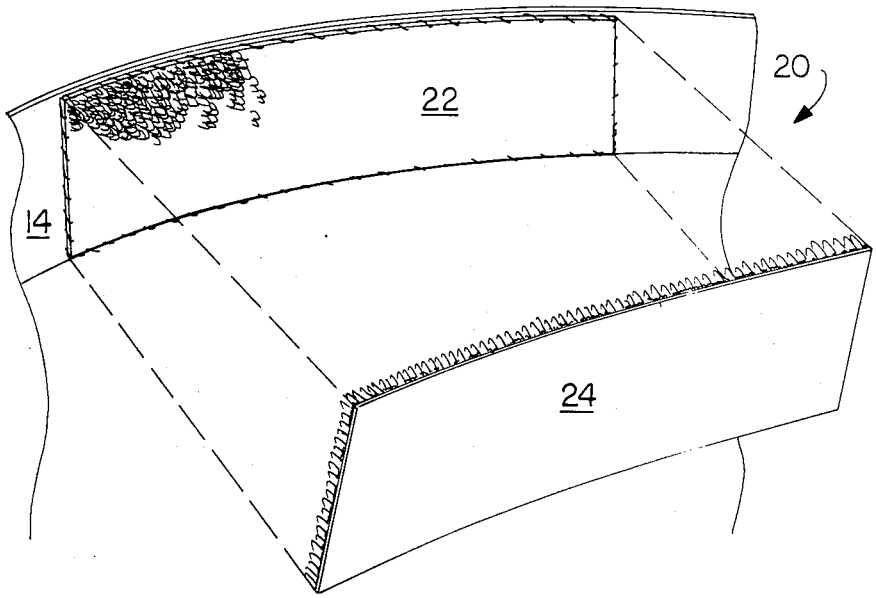
FIG. 4 is an enlarged perspective view, with parts broken away, of the waist band adjustment of the present invention.

Waist band adjustment 20 comprises a first flexible strip 22 which is stitched or otherwise secured to the inside of waist band 14 of shorts 10. First flexible strip 22 has an outer facing of VELCRO loops (see FIG. 3) substantially covering the entire surface thereof. A second flexible strip 24 having a generally coextensive length and width to first flexible strip 22 is provided for removable attachment to first flexible strip 22 as necessary in order to accommodate for a change in waist size due to modest weight gain or loss. Second flexible strip 24 includes VELCRO hook fasteners which cover substantially the entire surface of one side thereof and facilitate releaseable engagement of second flexible strip 24 with first flexible strip 22. This is clearly illustrated in FIGS. 3 and 4. A padded backing (not shown) may also be provided on the body contact side of second flexible strip 24 as a matter of design choice in order to better accommodate changes in waist size. It is believed that a pair of waist band adjustments 20 when properly utilized may accommodate a waist size change of up to 1 and perhaps 1.5 inches without the necessity of having the garment attended to by a tailor.

The applicant presently believes that adjustments 20 may be provided with garments which are sold off the rack or may be sold independently of the garment as a kit. The kit would most suitably include two pairs of waist band adjustments 20 which could be used in conjunction with a selected garment by the purchaser thereof.

It will be understood that various details of the invention may be changed without departing from the scope thereof. Furthermore, the foregoing description is for the purpose of illustration only and not for the purpose of limitation--the invention being defined by the claims.

What is claimed is:

1. In combination with an apparel garmet of the type having a waist band at the top thereof, a waist band adjustment means comprising at least one first flexible strip with a length of about one-half or less than the length of the garmet waist band secured internally to the waist band of said garment and. having fastening means on at least a portion of the outer face thereof, and at least one second flexible strip for attachment to said first flexible strip and being substantially coextensive therewith, said second flexible strip having fastening means on at least a portion of one face thereof for releaseably engaging the fastening means of said first strip, whereby said second strip may be removed and attached to said first strip according to increases and decreases, respectively, in the waist size of a person wearing the apparel garment.

2. The combination according to claim 1 wherein a plurality of first flexible strips are secured in spaced-apart relation to said waist band and a plurality of corresponding second flexible strips are provided for attachment thereto.

3. The combination according to claim 2 wherein said fastening means for securing said plurality of first flexible strips to said corresponding plurality of second flexible strips comprises filamentary loops and hooks type fasteners.

4. The combination according to claim 2 wherein said plurality of first flexible strips are each sewn to the waist band of said garment.

5. An apparel garment waist band adjustment means comprising at least one first flexible strip with a length of about one-half or less than the length of a garment waist band having fastening means on one surface thereof, and at least one second flexible strip having fastening means on one surface thereof adapted for releaseably engaging the fastening means of said first flexible strip and being substantially coextensive with said first strip, whereby said first strip may be secured to the inside of the waist band of said apparel garment and said second strip removed and attached thereto according to increases and decreases, respectively, in the waist size of a person wearing the apparel garment.

6. An apparel garment waist band adjustment according to claim 5 comprising a plurality of said first flexible strips and a plurality of said second flexible strips.

7. An apparel garment waist band adjustment according to claim 6 wherein said fastening means for securing said plurality of first flexible strips to said corresponding plurality of second flexible strips comprises filamentary loops and hooks type fasteners.

8. An apparel garment waist band adjustment according to claim 6 wherein said plurality of first and second strips comprises two of each of said first and second strips, said first and second strips being substantially coextensive.

* * * * *